United States Patent [19]

Denny et al.

[11] 4,392,757

[45] Jul. 12, 1983

[54] BACKLASH AND RUNOUT COMPENSATOR FOR LEAD SCREW DRIVES

[75] Inventors: Clifford M. Denny, Lexington, Ky.; Charles W. Wampler, II, Harrisonburg, Va.

[73] Assignee: International Business Machines Corporation, Armonk, N.Y.

[21] Appl. No.: 152,206

[22] Filed: May 22, 1980

[51] Int. Cl.[3] ..... B41J 19/20

[52] U.S. Cl. ..... 400/328; 74/414.8 A; 74/441

[58] Field of Search ..... 400/305, 328; 74/409, 74/424.8 R, 424.8 A, 441, 459; 409/146, 169

[56] References Cited

U.S. PATENT DOCUMENTS

| | | | |
|---|---|---|---|
| 641,916 | 1/1900 | Wright | 400/328 X |
| 2,903,902 | 9/1959 | Berggren | 74/441 |
| 3,094,011 | 6/1963 | Bradley | 74/441 |
| 3,119,307 | 1/1964 | Opferkuch | 74/441 |
| 3,382,731 | 5/1968 | Whicker | 74/424.8 A |
| 3,563,107 | 2/1971 | Nilsson | 74/441 |
| 3,703,835 | 11/1972 | O'Connor et al. | 74/441 |
| 3,713,349 | 1/1973 | Benson | 74/409 |
| 3,945,481 | 3/1976 | Lindberg | 400/328 |
| 3,977,262 | 8/1976 | Randolph | 74/424.8 R |
| 4,071,866 | 1/1978 | Butsch | 74/409 X |

FOREIGN PATENT DOCUMENTS

| | | |
|---|---|---|
| 205822 | 10/1959 | Austria . |
| 604181 | 8/1960 | Canada . |
| 1241158 | 8/1960 | France . |

OTHER PUBLICATIONS

Product Engineering, "Eliminating Backlash", Honegger, Jul. 1939, pp. 302–303, 74/441.

*Primary Examiner*—Ernest T. Wright, Jr.
*Attorney, Agent, or Firm*—William J. Dick

[57] ABSTRACT

Disclosed is drive apparatus especially useful for controllably displacing the carrier of a printer, the drive apparatus including a lead screw having laterally spaced apart and floating threaded followers thereon. Intermediate the threaded followers are a first pair of preloaded springs which press the followers against the opposite flanks of the threads on the lead screw to thereby inhibit backlash intermediate the followers. A second pair of springs are mounted intermediate a bracket, which is fastened to the carrier, and at least one of the followers for effecting coupling between the carrier and the follower while controlling backlash therebetween. A pair of arms extend from the followers and are coupled to a restraining shaft in such a manner as to inhibit rotational movement of the arms (and thus the followers) while permitting motion of the followers in any perpendicular direction to the lead screw to accommodate runout or eccentricity.

21 Claims, 9 Drawing Figures

BACKLASH AND RUNOUT COMPENSATOR FOR LEAD SCREW DRIVES

SUMMARY OF THE INVENTION AND STATE OF THE PRIOR ART

The present invention relates to drive apparatus and more particularly relates to lead screw drive apparatus especially useful for a printer having means for accommodating both lead screw and print carrier coupling backlash, and lead screw oscillation.

Numerous drives are provided for printers, including the popular pulley and band, ratchet and pawl as well as lead screw with follower nut. In interactive printers (typewriters and the like), especially those of the non-impact type, it is essential that the carrier for the printhead be stable with regard to the drive apparatus, that it not oscillate upon cessation of drive, and accord a minimum of backlash during steady state or constant running so that print position may be accurately controlled. In a continuous or Sweet type ink jet printer wherein indicia are printed by a vertical sweep of droplets, for example, the speed of the movement of the carrier must be uniform during the printing operation or print distortion will occur. In a band and pulley type drive wherein the drive motor is connected to an endless band which extends around pulleys and is connected to the carrier so that reversing the direction of the motor will effect reversing of the direction of the carrier, the spring tension effected even with steel bands, while being highly reliable and inexpensive creates problems with regard to regulating the motor drive control and controlling the print position of the carrier. Accordingly, a directly connected drive such as a lead screw wherein a single monitor may be employed for both carrier position and motor control is preferable but for the problems normally associated with lead screw drives. The lead screw type drive conventionally has problems relating to drive efficiency because of the high power consumption required to move a carrier coupled thereto as by nut like followers, has difficulty with regard to backlash especially on drive or lead screw reversal, and if there is any eccentricity in the lead screw itself, the carrier will tend to oscillate (along with the printhead) having a disasterous effect on print quality due to uneveness of the print line.

The prior art discloses numerous methods and means for inhibiting backlash in gear trains, lead screws and the like. The most relevant art appears in U.S. Pat. No. 2,903,902 (col. 1, paragraph 3); U.S. Pat. No. 3,119,307 (col. 1, paragraph 5); U.S. Pat. No. 3,094,011; U.S. Pat. No. 4,071,866; U.S. Pat. No. 641,916; U.S. Pat. No. 3,563,107; an article entitled "Eliminating Backlash" by John A. Honegger in "Product Engineering", July 1939, pages 302 and 303; Canadian Pat. No. 604,181; Austrian Pat. No. 205,822; and French Pat. No. 1,241,158. However, none of the references discloses or otherwise teaches the apparatus of the present invention.

In view of the above, it is a principle object of the present invention to eliminate backlash in a lead screw type drive during steady state operation when backlash is objectionable, while allowing limited backlash during acceleration and deceleration so that frictional drag between nut and lead screw may be held to a minimum, thereby reducing power consumption of the mechanism to a minimum.

Another object of the present invention is to accommodate lead screw runout, or eccentricity, in a novel lead screw drive apparatus so that resulting transverse motion of the lead screw does not affect apparatus connected thereto in order to permit the lead screw to turn freely without lateral constraint except at each end by its own bearings, so as to eliminate binding, (resulting in wear), and excessive power consumption due to friction.

A further object of the present invention is to provide adjustment means whereby backlash may be adjusted without increasing follower nut preload forces over that necessary to prevent any tendency of nut separation from the flanks of the threads of the drive screw during steady state operation although insufficient to prevent such separation during acceleration or deceleration so as to reduce power consumption required for both steady state and intermittent operation.

A still further object of the present invention is to provide such adjustability in apparatus of the instant type including means to compensate for wear on both the lead screw and the followers.

Another object of the present invention is to provide the novel lead screw type apparatus in a printer.

Other objects and a more complete understanding of the invention may be had with reference to the following specification and claims taken in conjunction with the accompanying drawing.

DRAWING DESCRIPTION

Figure 1:
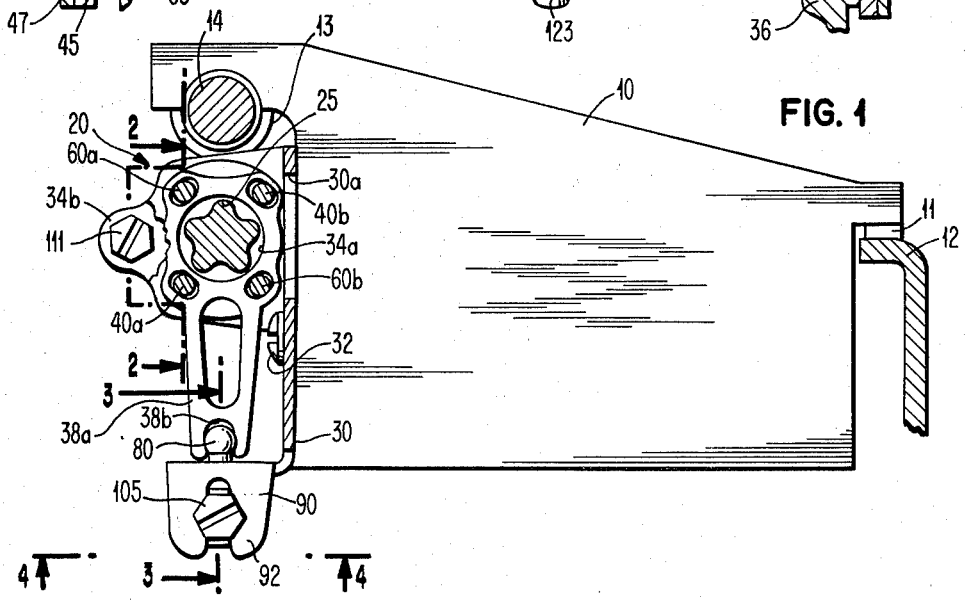
FIG. 1 is a fragmentary side elevational view of drive apparatus constructed in accordance with the present invention.

Turning now to the drawing and especially FIG. 1 thereof, a typical printer carrier 10 (whether the printer is active or interactive such as a typewriter), for example of an ink jet printer (not shown), is illustrated as including a forward support member 11 for engagement with a rail 12 mounted on the chassis of the machine. The after portion of the carrier 10 includes a strap supported bearing 13 to constrain the carrier 10 against a carrier guide shaft and the like 14, and by drive apparatus 20, constructed in accordance with the present invention, to permit displacement in a predetermined path of the carrier 10 into and out of the plane of the drawing. At the outset it should be recognized that the drive apparatus 20 of the present invention is equally applicable to moveable work members (including work pieces or tools) where conditions exist which would permit of limited backlash during initial acceleration or final deceleration but wherein during steady state movement no backlash is permitted; or where it is desired to adjust the backlash to some predetermined value from zero to maximum, the amount of backlash being dependent upon the system tolerance desired by the work member designer. However, in the illustrated instance, the drive apparatus 20 of the present invention is shown employed in conjunction with a printer carrier 10 as an example of the use of the drive apparatus 20, inasmuch as the drive apparatus 20 is ideally suited for this type of use.

In accordance with the invention, novel drive apparatus 20 is coupled to the work member, in the present instance a carrier 10, to effect movement thereof while permitting limited backlash during acceleration/deceleration while inhibiting such backlash during steady state movement. To this end, and referring first to FIGS. 1 and 2, a lead screw 25 which includes threads 26 thereon having opposite flanks 27 and 28 respectively, is shown connected to a motor drive means or the like 29. The coupling of the lead screw 25 to the motor drive means 29 may be by any convenient manner, commensurate with the load presented by the work member to be driven. The lead screw 25 may be supported for example at its opposite ends in any conventional manner.

The apparatus 20 includes a mounting bracket 30 which is rigidly coupled, in the illustrated instance, to the carrier 10 as by screws 31 and 32, and includes sidewalls or flange portions 33 and 34, respectively, which are laterally spaced apart and project substantially longitudinally to the longitudinal axis of the lead screw 25 with enlarged apertures 33*a* and 34*a* therein to permit the passage therethrough of the lead screw 25. It should be recognized that the bracket 30 may form an integral part of the work member or carrier 10, the separate bracket 30 only being useful for allowing preassembly of certain of the parts herein after discussed.

Mounted intermediate the flange portions 33 and 34 are first and second, spaced apart, internally threaded follower nuts 35 and 36 respectively which engage the threads 26 on the lead screw 25. Each of the follower nuts 35 and 36, in the present instance, includes a circumferentially extending recessed portion 35*a*, 36*a* to receive and be coupled to a follower nut holder sleeve or annulus 37 and 38 respectively, the nut holder sleeves 37 and 38 each including radially extending nut holder arms 37*a*, 38*a* for purposes which will be made clear hereinafter. Suffice at this time that one of the purposes of the nut holder arms 37*a*, 38*a* is to couple the follower nuts 35 and 36 in a manner which will inhibit their rotation with the lead screw 25.

In order to inhibit backlash of the follower nuts 35 and 36, biasing means in the form of a compression spring 50 is provided intermediate the threaded follower nuts 35 and 36 for biasing the threaded follower nuts 35 and 36 against opposite flanks 27 and 28 of the threads 26 of the lead screw 25. To this end, and referring to FIGS. 1 and 2, a pair of diametrically opposed shafts 40*a* and 40*b* are passed through recessed portions 35*a* and 36*a* associated with the first and second follower nuts 35 and 36 and nut holder sleeves 37 and 38. Each of the shafts 40*a* and 40*b* as well as its associated hardware, hereinafter discussed, is identical in structure and therefor reference numerals will be depicted as those belonging to the shaft 40*a* in FIG. 2. In this connection, FIGS. 1 and 2*a* show the spatial relationship between the various parts of the drive apparatus 20 of the present invention.

Each of the shafts 40*a* and 40*b* includes shoulder portions 41 and 42 and reduced diameter projecting stub ends 43 and 44, the stub ends 43 and 44 being fitted within suitable apertures in a bearing plate 45 and 46 and loading pads 47 and 48, the loading pads 47 and 48 being pressed against the interior of the flange portions 33 and 34 respectively. As illustrated, the shoulder portions 41 and 42 are spaced from the bearing plates 45 and 46 so that the shaft 40*a* is free for limited axial movement within the recessed portions 35*a*, 36*a*.

Circumscribing the shaft 40*a* and pressing against the interior of the nut holder sleeves 37 and 38 are spacer washers 49*a*, 49*b* which serve as end plates for the biasing means, in the illustrated instance, a compression spring 50 which serves to press the nut holder sleeves 37 and 38 outwardly (tends to separate them) which in turn tends to separate or press the first and second follower nuts 35 and 36 outwardly against opposite flanks 27 and 28 of the threads 26 of the lead screw 25. Circumscribing the spring 50, in the present instance, is a spacer sleeve 51 which serves as a stop means for spring preload, the sleeve 51 preferably having an axial length less than the space between the two follower nut holder sleeves 37 and 38 with the follower nuts 35 and 36 biased apart. As will be seen hereinafter, the nut 36 (second follower) is in effect the drive nut for the apparatus 20. For example, with the lead screw 25 turning in a direction to effect motion of the mounting bracket 30, and thus the carrier 10, in a left to right direction (reference FIG. 2), inasmuch as nut 35 has threads which engage the flank 28 of the screw threads 26 of the lead screw 25, that nut or first follower 35 will tend to move to the right, pushing against the biasing spring 50 tending to urge the second follower nut 36 against its thread or flank 27 of the threads 26. If the resistance that nut 36 meets is greater than the biasing force of spring 50, spring 50 compresses until the sleeve 51 will be rigidly engaged between the nut holder arms 37*a* and 38*a* pressing the nut 36 against the bearing plate 46 and loading pad 48 and thus against the flange portion 34 causing the bracket 30 and thus the carrier 10 to move to the right.

Upon the bracket 30 achieving motion (effects of inertia overcome) the follower nuts 35 and 36 will tend to separate due to the biasing of the spring 50 thus eliminating backlash during steady state motion of the carrier 10.

Figure 6:
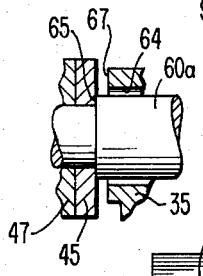
FIG. 6 is an enlarged fragmentary sectional view of a portion of the apparatus illustrated in FIG. 2, and identified by the dashed lines with the legend FIG. 6.
Figure 7:
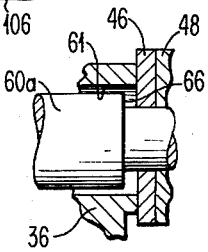
FIG. 7 is a like representation of a portion of the apparatus illustrated in FIG. 2 and designated by dashed lines with the legend FIG. 7 thereon.

When the lead screw 25 is turning in a manner which tends to displace the carrier 10 and bracket 30 in the opposite direction, i.e., from right to left, the second follower nut 36 threads are pressed against the flank 27 of the threads 26 of the lead screw 25 and means must be provided to effect coupling of the nut or second follower 36 against the carrier 10 or flange portion 33 of the bracket 30. To this end, and referring to FIGS. 2, 6 and 7, a second shaft pair 60*a*, 60*b* which are diametrically opposed as illustrated in FIGS. 1 and 2*a*, pass through bores 61, 62 in second follower 36 and nut holder sleeve 38 respectively, and bores 63, 64 in nut holder sleeve 37 and first follower nut 35. Referring to FIGS. 6 and 7, similar to shaft 40*a*, the shafts 60*a* and 60*b* include shoulders 65 and 66, the shoulder 65 abutting (by means hereinafter described) the bearing plate 45 pressing the bearing plate 45 against the loading pad 47 and thus against the flange portion 33 of the bracket 30. As shown in FIG. 6, a space 67 exists between the first follower nut 35 and the bearing plate 45 so that the first follower nut 35 does not contact the bearing plate 45.

Intermediate the first and second follower nuts 35 and 36, respectively, and circumscribing the shaft 60*a* (inasmuch as the parts on shaft 60*b* are identical, this description is with reference to parts on both of said shafts 60*a* and 60*b*) is a second biasing means also in the form of a compression spring 70. The compression spring 70 abuts a spacer washer 71 on the nut holder sleeve 38, and abuts, at its opposite end, a flange or abutment 72 rigidly secured to the shaft 60*a*. In this manner, the spring 70 tends to urge the shaft 60*a* to the left (reference FIG. 2) causing the shoulder 65 to abut the bearing plate 45 providing pressure through the loading pad 47 against the flange portion 33. Moreover, circumscribing the compression spring 70 is a sleeve 74 which has a shorter axial length than the normal spring unloaded distance between the spacer washer 71 and the flange or abutment 72 capturing the spring 70 therebetween. In this manner, a space is effected between the ends of the sleeve 74 and the washer 71 and flange or abutment 72 on the shaft 60*a*, the sleeve 74 acting as stop means to limit the spring loading.

In operation, as the lead screw 25 is turned to effect displacement of the bracket 30 and, in the present instance therefore the carrier 10 in a direction from right to left (reference FIG. 2), pressure on the second follower nut 36 tends to compress the spring 70 to overcome the inertia of the carrier 10. Compression of the biasing spring 70 in turn applies force to the shaft 60*a* against the shoulder or abutment or flange 72 on the shaft 60*a*. In this manner an increased pressure from the shaft 60*a* is applied to the bearing plate 45, loading pad 47 and thus the flange portion 33 of the bracket 30. If the inertia to be overcome is in excess of that carried by the spring 70, the spring 70 will tend to compress until the stop means or sleeve 74 engages both the spacer washer 71 and the abutment or flange 72 on the shaft 60*a*. This action forces coupling (rigid at that point) between the follower nut 36 and the flange portion 33 by way of the shaft 60*a* (and 60*b*) effecting carrier movement. Upon the inertia being overcome, and the carrier 10 being placed into motion, the frictional forces decrease, allowing the biasing spring 70 to overcome those forces causing a separation and unloading of the biasing sleeve 74, which will occur therefore in the steady state condition. Thus the spring 70 is in actuality intermediate the bracket 30 (or carrier 10) and the second follower nut 36 for effecting coupling between the carrier 10 and the follower nuts 35 and 36 while controlling backlash therebetween during both startup (a permissive amount of backlash) and steady state conditions wherein no further backlash occurs.

Preferably the first and second follower nut 35 and 36 are composed of a material softer than the material of the lead screw 25 so as to inhibit wear in the lead screw 25. Such materials as DELRIN AF (trademark of E. I. DuPont de Nemours & Co.) as used with a rolled thread lead screw (or other threaded lead screw) composed of steel is a suitable combination.

In order to compensate for wear, while also permitting adjustments of the amount of initial backlash between zero and maximum, both between the first and second follower nuts 35 and 36, as well as between the carrier 10 and the second follower nut 36, separate adjustment means are provided. To this end, and referring now to FIGS. 1–5, the extending nut holder arms 37*a* and 38*a* are provided with enlarged recessed end portions such as at 37*b*, 38*b*, the enlarged recessed end portions 37*b* and 38*b* serving to capture or embrace nut restraining pins 81 and 80 respectively. As shown best in FIG. 1, the recessed end portions 37*b* and 38*b* are formed in the shape of a receptacle to allow, for purposes which will be more fully explained hereinafter, end clearance between the top of the pins 81 and 80 and the bottom of the receptacles 37*b*, 38*b*. The pins 81 and 80 include depending tenons 81*a* and 82*a* which pass through enlarged slot like apertures 95 and 96 in the projecting bracket extension 90. As illustrated, the bracket extension 90 includes depending bifurcated leg portions 91 and 92, which permit passage therethrough of an adjustment bolt 100. As illustrated best in FIG. 3, the tenons 81*a* and 82*a* are captured in a nut restraining member or plate 83, the member 83 including a central aperture 84 which is aligned, in assembly, with an aperture 93 in the bracket extension 90, and an aperture or slot 85 in a cam bracket 86. As best illustrated in FIG. 4, the cam bracket slot 85 is elongated in a longitudinal direction of the bracket 86, the bracket 86 also including depending leg portions 87 and 88, the leg portion 87 including a threaded aperture 87*a* therein and the leg portion 88 including an enlarged aperture 88*a* therein for receipt therethrough of the adjustment bolt 100. A pin 97 including an enlarged head portion 97*a*, is passed through the slots and apertures 84, 85 and 93 and held in place as by a C-clip or the like 98 which is received in the circumferentially extending slot 97*b* at the lower end of the pin 97. In order to effect pressing engagement between the bracket extension 90, the nut restraining member or plate 83, and the cam bracket 86, a loading spring 99 is preferably interposed intermediate the enlarged head portion 97*a* of the pin 97 and the upper surface of the bracket extension 90.

Figure 2:
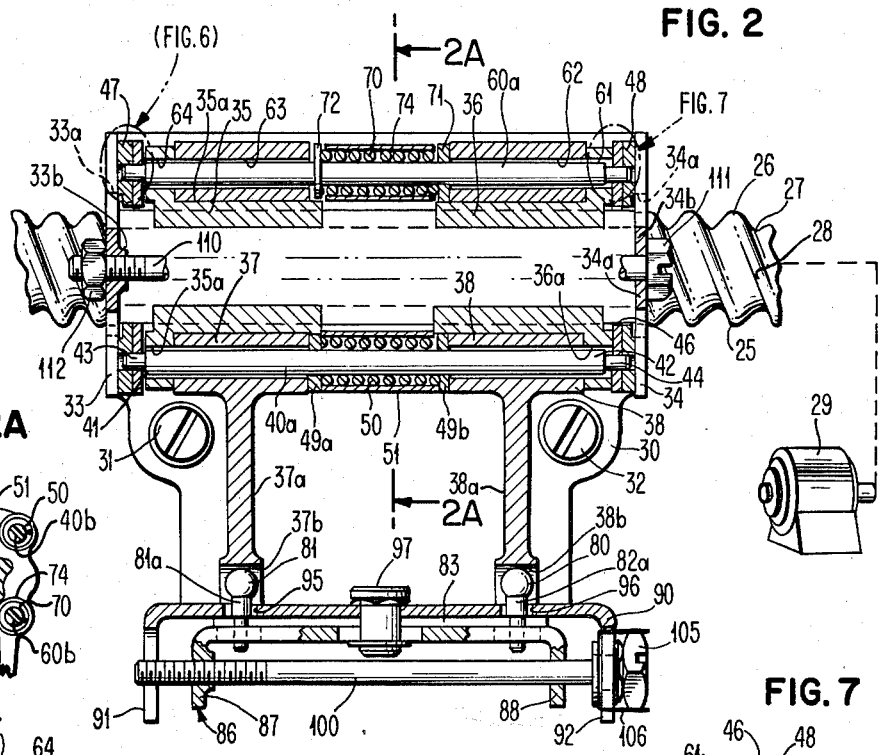
FIG. 2 is an enlarged fragmentary sectional view taken along line 2—2 of FIG. 1.
Figure 2A:
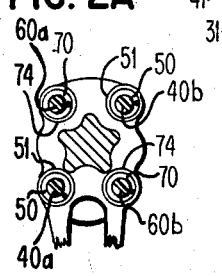
FIG. 2A is a fragmentary sectional view taken along line 2A—2A of FIG. 2 and as if FIG. 2 were not in section.
Figure 3:
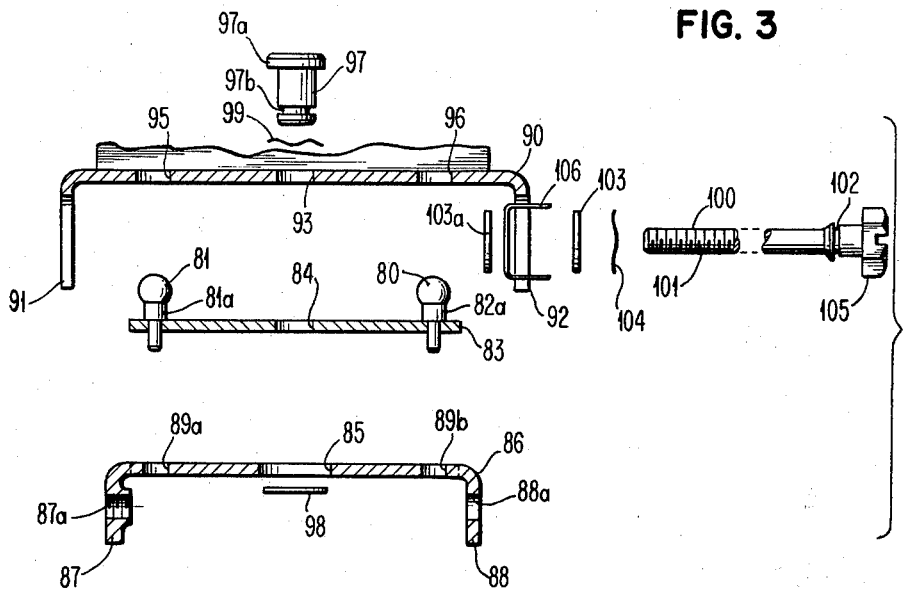
FIG. 3 is a fragmentary sectional exploded view of a portion of the apparatus illustrated in FIG. 1 and taken along line 3—3 of FIG. 1.
Figure 4:
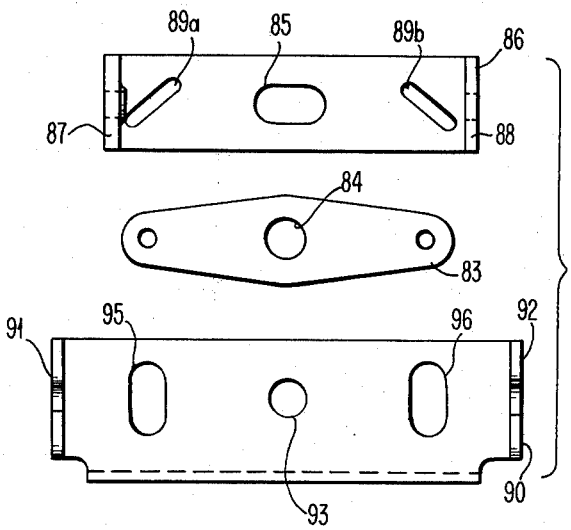
FIG. 4 is an exploded view in bottom plan of a portion of the apparatus illustrated in FIG. 3 and as viewed in line 4—4 of FIG. 1.
Figure 5:
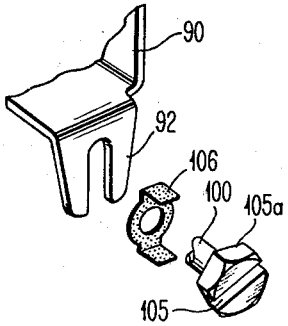
FIG. 5 is a fragmentary exploded perspective view of a portion of the apparatus illustrated in FIGS. 1-3.

As shown in FIGS. 2 and 3, the adjustment bolt 100 includes a threaded end portion 101 adapted to register with the threads of the aperture 87*a* in the cam bracket 86, and includes a circumferentially extending recess or slot 102 which is engageable by a C-clip 103 to hold the adjusting bolt 100 in position (to prevent axial displacement thereof) relative to the leg portion 92 of the extension 90. A washer 103*a* helps sandwich a wave spring 104, similar to the loading spring 99 associated with the pin 97, against the head 105 of the adjusting bolt 100. A detent spring 106 is preferably captured intermediate the bifurcations of the leg portion 92 of the bracket extension 90 and serves to engage the flats 105*a* of the head 105 of the bolt 100 to inhibit slipping thereof.

In operation, as the adjusting bolt 100 or nut restraining bolt 100 is rotated, the cam bracket 86 tends to move axially or longitudinally intermediate the leg portions 91 and 92 of the bracket extension 90. The depending terminal ends of the tenons 81*a*, 82*a* of the pins 81 and 80 are captured in cam slots 89*a*, 89*b* of the cam bracket 86 and act as cam followers tending to effect rotation of the nut restraining member or plate 83 in order for the pins 80 and 81 to follow the cam slots 89*a* and 89*b* thereby causing the nut holder arms 37*a* and 38*a* to move or rotate in opposite directions. In this manner, the initial backlash and spring 50 preload may be adjusted between the first and second follower nuts 35 and 36 respectively. Turning the adjustment bolt 100 or nut restraining bolt 100 in the opposite direction will cause rotation of the arms 37*a* and 38*a* oppositely in the opposite direction causing, for example, an increase in the backlash, and lessening of the friction in the system during startup conditions.

It should be recognized that all that is necessary to enable adequate adjustment of the nut to lead screw backlash is to be able to rotate the first follower nut 35 in an opposite direction with respect to the second follower nut 36. Anything that permits accomplishing this task will permit adjustment of the nut to lead screw backlash. However, the apparatus described above will permit of precise adjustment despite the differences from unit to unit of the compression spring 50 (first biasing means) employed intermediate the nut holder sleeves 37 and 38.

In order to permit adjustment of the backlash between the follower nut (in the present instance the second follower nut 36) and the bracket 30, a carrier backlash adjusting screw 110 (see FIG. 2) is connected through tabs 34*b* and 33*b* on the flange portions 34 and 33. The carrier backlash adjusting screw 110 includes a head end 111 which presses against the tab 34*b* while the screw 110 is captured at its opposite end as by a conventional nut 112 which permits closing the distance (or opening the distance) by deflection of the tabs 33 and 34 and thus the flange portions 33 and 34 for effecting a preload adjustment on the second biasing means or spring 70. Accordingly, the space intermediate the ends of the sleeve 74 may be increased or decreased.

A close examination of the structure heretofore described will indicate that neither the first and second follower nuts 35 and 36 nor any associated part is, in fact, connected rigidly to the bracket 30. Accordingly, by allowing clearance between the head of the pins 81 and 80 and the seat of the recessed end portions or receptacles 37*b*, 38*b* on the extended ends of the nut holder arms 37*a* and 38*a* permits the first and second follower nuts 35 and 36 to move vertically if the lead screw 25 exhibits moderate degrees of eccentricity. In a like manner, as best illustrated in FIG. 1, the bracket 30 includes an opening 30*a* in the rear portion thereof intermediate the follower nuts 35 and 36 and associated nut holder sleeves 37 and 38 and the work member (in the present instance carrier 10) to permit limited lateral eccentric movements due to eccentricity or runout of the lead screw 25. The enlarged or oversize lead screw entrance and exit apertures 33*a*, 34*a* in the flange portions 33 and 34 accommodate any eccentricity.

Figure 8:
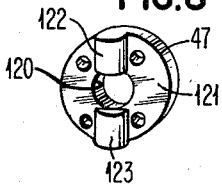
FIG. 8 is a perspective view of a portion (loading pad) of the apparatus illustrated in FIGS. 2, 6 and 7.

The carrier backlash adjustment screw 110, when adjusting for the backlash in the second biasing means or spring 70 intermediate the second follower nut 36 and the flange portion 33 of the bracket 30 may cause inward or outward deflection of the flange portions 33 and 34. Moreover, because of the possibility of slight amounts of assembly misalignment when the apparatus is positioned on the lead screw 25, it is preferable that the loading pads 47 and 48 include a structure similar to that illustrated in FIG. 8. Because only a single loading pad need be shown, it is assumed that loading pad 47 and loading pad 48 are identical in construction and loading pad 47 is thus the only pad described. As illustrated in FIG. 8, loading pad 47 comprises a disc having a central aperture 120 therein of a greater diameter than the tooth tip to tooth tip diameter of the lead screw 25. Projecting from one planar surface 121 of the disc are a pair of cylindrical or rounded protrusions 122 and 123 which are adapted for engagement with the interior of the projecting flange portion 33. Thus even though the flange portions 33 and 34 of the bracket 30 are drawn together as by pressure exerted on the tabs 33*a* and 34*a* by the carrier backlash adjustment screw 110, the flange portions 33 and 34 tend to rotate on the cylindrical protrusions 122 and 123 maintaining essential parallelism of the loading pads 47 and 48 and thus the first and second follower nuts 35 and 36 as well as other structure intermediate the flange portions 33 and 34.

Thus the drive apparatus 20 of the present invention eliminates backlash in the lead screw type drive during steady state operation when backlash is objectionable, while allowing limited backlash during acceleration and deceleration so that frictional drag between follower nuts 35 and 36 and lead screw 25 is held to a minimum, thereby reducing power consumption of the mechanism to a minimum. Moreover, with the novel drive apparatus 20 heretofore described, any tendency of the lead screw 25 to oscillate due to eccentricity or runout is compensated for by the floating nature of the assembly intermediate the attachment means to the object being driven. Moreover, as described, the apparatus 20 of the present invention permits of the adjustment of backlash and follower nut preload as well as preload of the coupling between the follower nuts 35 and 36 and the work member being driven thereby permitting of compensation for wear and for adjustment of each individual machine being operated by the drive apparatus 20.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed.

What is claimed is:

1. Drive apparatus for a work member, said apparatus comprising:

a lead screw having threads thereon, and motor means for effecting bi-directional rotation of said lead screw;

first and second laterally spaced apart threaded followers on said lead screw, first biasing means intermediate said threaded followers for biasing said threaded followers against opposite flanks of said threads of said lead screw to thereby inhibit backlash intermediate said followers; and second biasing means intermediate said work member and at least one of said followers for effecting coupling between said work member and said followers while controlling backlash therebetween.

2. Drive apparatus in accordance with claim 1 including radially projecting arms extending from said followers; and means coupling said arms to said work member for inhibiting rotational movement of said arms while permitting motion thereof in a direction parallel and perpendicular to said lead screw.

3. Drive apparatus in accordance with claims 1 or 2 including adjustment means for effecting rotation of at least one of said followers on said lead screw relative to the other of said followers for adjusting the preload on said first biasing means.

4. Drive apparatus in accordance with claim 3 wherein said adjustment means includes means for rotating both of said followers in opposite directions on said lead screw for backlash preload adjustment intermediate said followers.

5. Drive apparatus in accordance with claim 3 including stop means intermediate said followers for limiting first biasing means preload.

6. Drive apparatus in accordance with claim 1 including adjustment means for preloading said second biasing means to adjustably control the backlash between said work member and said at least one follower.

7. Drive apparatus in accordance with claim 6 including stop means intermediate said work member and said at least one of said followers for limiting the preload adjustment by said adjustment means on said second biasing means.

8. Drive apparatus in accordance with claim 3 including separate adjustment means for preloading said second biasing means, and stop means intermediate said work member and said at least one of said followers for limiting the preload adjustment of said second biasing means.

9. Drive apparatus for displacing a work member, said apparatus comprising:

a threaded lead screw and means to effect bi-directional rotation thereof;

means to guide said work member in a predetermined path substantially parallel to said lead screw; spaced apart sidewall portions on said work member, and means defining enlarged entrance and exit apertures in said sidewall portions for passage therethrough of said lead screw;

first and second spaced apart internally threaded follower nuts on said lead screw, first spring biasing means for urging said follower nuts apart so that the threads thereof engage against opposite flanks of the threads of said lead screw;

projection means extending from said follower nuts, means on said work member engaging said projection means for inhibiting rotation of said follower nuts relative to said lead screw, and second spring biasing means intermediate one of said follower nuts and one of said sidewall portions to effect displacement of said work member upon rotation of said lead screw.

10. Drive apparatus in accordance with claim 9 including first adjustment means on said work member for adjusting the preload of said first spring biasing means.

11. Drive apparatus in accordance with claim 10 wherein said projection means comprises a pair of radially extending arms having means at one end portion for engagement with said adjustment means on said work member, said adjustment means including means for displacing said engaging means on said work member for effecting counter rotation of said arms to axially displace said follower nuts in opposite directions thereby altering the preload of said first spring biasing means and the backlash between said follower nuts and said lead screw.

12. Drive apparatus in accordance with claim 11 wherein said engaging means comprises cam follower means, and said means for displacing said engaging means comprises cam means coupled to said cam follower means to effect said counter rotation of said arms upon movement of said cam means.

13. Drive apparatus in accordance with claims 9 or 10 or 12 including adjustment means on said work member for adjusting the preload of said second spring biasing means.

14. Drive apparatus in accordance with claim 13 wherein said adjustment means of claim 13 comprises means for effecting deflection of said sidewall portions.

15. Drive apparatus in accordance with claim 9 including separate loading pad means intermediate each of said follower nuts and said sidewall sidewall portions.

16. Drive apparatus in accordance with claim 15 wherein each of said loading pad means comprises a disc having a central aperture therein to permit the passage therethrough of said lead screw, and cylindrically shaped protrusions projecting from one major surface of each of said discs for contact with said sidewall portions of said work member.

17. Drive apparatus in accordance with claim 9 or 10 or 12 including circumferentially spaced apart, longitudinally extending shaft means projecting through said follower nuts, and longitudinally displaceable with respect to said nuts, said shaft means comprising first and second pairs of shafts, each shaft of a pair being diametrically opposed to the other shaft of the same pair; said first spring biasing means comprising a first pair of springs disposed on said first pair of said diametrically opposed shafts in pressing engagement with said follower nuts, said second spring biasing means comprising a second pair of springs disposed on said second pair of diametrically opposed shafts, said second pair of shafts each including an abutment, said second pair of springs being positioned intermediate said abutment and one of said follower nuts to thereby bias said second pair of shafts towards one of said sidewall portions.

18. Drive apparatus in accordance with claim 17 including a first pair of sleeve means circumscribing said first pair of shafts, said sleeve means having a shorter axial length than the distance between said follower nuts when said lead screw is not effecting displacement of said work member.

19. Drive apparatus in accordance with claim 18 including a second pair of sleeve means circumscribing said second pair of shafts, each of said second sleeve means having a shorter axial length than the distance between said abutment and said one of said follower nuts when said lead screw is not effecting displacement of said work member.

20. Drive apparatus in accordance with claim 19 including adjustment means on said work member for adjusting the preload of said second spring biasing means.

21. Drive apparatus in accordance with claim 20 including separate loading pad means intermediate each of said follower nuts and said sidewall portions.

* * * * *